US006695603B2

(12) United States Patent
Bachmann et al.

(10) Patent No.: US 6,695,603 B2
(45) Date of Patent: Feb. 24, 2004

(54) ECCENTRIC TOOTHED ROTOR SET HAVING PLANETARY GEARS ON THE INNER ROTOR

(75) Inventors: Josef Bachmann, Obersinn (DE); Eberhard Ernst, Eichenzell (DE)

(73) Assignee: GKN Sinter Metals GmbH (DE)

( * ) Notice: Subject to any disclaimer, the term of this patent is extended or adjusted under 35 U.S.C. 154(b) by 0 days.

(21) Appl. No.: 10/235,687

(22) Filed: Sep. 4, 2002

(65) Prior Publication Data

US 2003/0072665 A1 Apr. 17, 2003

Related U.S. Application Data

(63) Continuation of application No. PCT/EP01/01481, filed on Feb. 10, 2001.

(30) Foreign Application Priority Data

Mar. 5, 2000 (DE) ..... 100 10 170

(51) Int. Cl.[7] ..... F01C 1/10
(52) U.S. Cl. ..... 418/171
(58) Field of Search ..... 418/166, 171

(56) References Cited

U.S. PATENT DOCUMENTS 3,619,089 A * 11/1971 Pierrat ..... 418/171
3,979,167 A * 9/1976 Grove ..... 418/171
5,595,479 A 1/1997 Hansen et al. ..... 418/61.3

FOREIGN PATENT DOCUMENTS

| | | | | |
|---|---|---|---|---|
| DE | 288340 | | 9/1913 | |
| DE | 20 51 066 | | 6/1971 | |
| DE | 3144572 | * | 5/1983 | ..... 418/166 |
| DE | 196 46 359 A1 | | 5/1998 | |
| DE | 199 22 792 A1 | | 11/2000 | |
| GB | 2028428 | * | 3/1980 | ..... 418/171 |

OTHER PUBLICATIONS

PCT International Provisional Examination Report dated Mar. 26, 2002; (International Ref. No. PCT/EP01/01481) English translation attached.

* cited by examiner

*Primary Examiner*—John J. Vrablik
(74) *Attorney, Agent, or Firm*—Woodcock Washburn LLP

(57) ABSTRACT

The invention is related to a toothed rotor set for a pump or engine consisting of a rotating outer rotor, which has an approximately star-shaped bore. The bore has a fine inner tooth system and an inner rotor aligned eccentrically inside it. The inner rotor has oil pockets for planetary gears. The planetary gears also have a fine tooth system with the help of which they roll on the fine teeth of the outer rotor. The planetary gears thus build a tooth system that translates into an outer tooth system. The outer tooth system has one tooth less than the inner tooth system of the outer rotor.

14 Claims, 7 Drawing Sheets

ECCENTRIC TOOTHED ROTOR SET HAVING PLANETARY GEARS ON THE INNER ROTOR

This is a Continuation of Application No. PCT/EP01/01481 filed Feb. 10, 2001, corresponding to Germany Application No. 100 10 107.4 filed Mar. 5, 2000.

BRIEF DESCRIPTION OF THE INVENTION

The invention relates to a toothed rotor set for a pump or an engine consisting of a rotating outer rotor. There is an inner rotor inside the outer rotor, which has bearing (oil) pockets for planetary gears. The toothed rotor set is similar to a ring pump with toothed execution. The function and procedure of the toothed rotor set correspond to the function and procedure of a toothed ring pump.

In toothed ring pumps, the pressure chamber is not separated from the suction chamber by a sickle shaped filling piece. Instead, a special shaping of the teeth—based on the trochoidal teeth system—ensures the sealing between the toothed ring and the outer toothed-pinion. The ring with inner teeth has one tooth more than the pinion, so that if the teeth are shaped properly, the tooth crests touch the exact tooth contact point. To ensure rolling, there must be a crest clearance between the tooth crest of the outer rotor and the tooth crest of the inner rotor. The disadvantage in the case of the ringed pump is that this crest clearance causes inner leakages that in turn lead to bad volumetric performance. In fact, at low speeds, it is not possible to build high pressures for this reason.

In comparison to a ringed pump, it is more advantageous to have a pump conforming to the principle of DE A 196 46 359. The pump is designed as a toothed rotor set consisting of a bearing ring with an inner tooth system and a gear placed eccentrically inside it, having outer teeth. The inner tooth system is formed by rollers that can rotate in the bearing ring, and it has one tooth more than the outer tooth system. A fine teeth system with an essentially smaller module is superimposed on the outer teeth of the gear.

Each roller has a fine tooth system on its circumference with the same module with which the teeth of the gear interlock.

The function of the toothed rotor set is that a drive momentum impacts against the inner rotor through a drive shaft, and makes it rotate. The toothed inner rotor transfers a force to the planetary gear, which on one hand manifests itself as an impact through the center of the planetary gear, and on the other, as a radial force that creates a torque for the planetary gear. The impact on the bearing ring causes it to rotate.

The known toothed rotor set has the disadvantage that a large number of planetary gears must be used to enable the function. And the use of a large number of planetary gears results in relatively higher incidence of friction, which the torque of the drive shaft connected to the inner teeth system must overcome. Another disadvantage of known toothed rotor sets is that when the inner rotor rotates, lubrication oil (grease) rotating in the same direction flows into the gaps between the teeth of the planetary gear from the pressure side to the suction side, and this flow lowers the efficiency of the pump.

The disadvantages of the latest technology status highlight the task of creating a toothed rotor set designed in such a way that for the same model size, a lesser number of planetary gears is used to reduce the incidence of friction. The task of the invention is also to create a toothed rotor set that offers larger pumping volumes and higher efficiency at comparable model sizes, than the known toothed rotor sets.

SUMMARY OF THE INVENTION

The problem is solved according the invention, by a toothed rotor set for a pump or an engine consisting of a rotating outer rotor with an approximately star shaped bore. The bore has a fine inner teeth system and an inner rotor aligned eccentrically inside it, having oil pockets for planetary gears.

The planetary gears have a fine teeth system with which they roll in the fine teeth system of the outer rotor. The outer teeth system has one tooth less than the inner teeth system of the outer rotor. The advantage of a toothed rotor system designed in this manner is that in comparison to known toothed rotor sets from the latest status of technology, the toothed rotor set conforming to the invention can be driven by a smaller number of planetary gears. This is because for the same model size, a smaller number of planetary gears are used than in the known toothed rotor sets conforming to the latest technology status. Smaller number of planetary gears further means smaller friction areas for example, between the planetary gears and the oil pockets of the inner rotor as well as between the teeth of the planetary gear and the teeth of the outer rotor. Less friction means that a pump or engine with a toothed rotor set conforming to the invention has greater efficiency than the pump or engine with the known toothed rotor set conforming to the latest technology status, because lesser torque must be used to overcome the friction in the system. From the perspective of design, the toothed rotor set enables a higher pumping volume than the known toothed rotor set conforming to the latest technology status.

In addition, the toothed rotor set conforming to the invention has a higher efficiency because when the inner rotor rotates in the clockwise direction, the planetary gears rotate in the anti-clockwise direction leading to an additional flow of lubricating oil in the gaps between the teeth of the planetary gears from the suction side to the pressure side.

A further problem of the fine teeth system is that the forces and moments that come into play are not optimally accepted by the involute teeth systems used thus far in the toothed rotor sets conforming to the traditional genre. In particular, there is the problem that the known teeth systems do not transfer the impact and radial forces in the linear direction without a high degree of surface friction.

The thus far known teeth systems are suitable only for transferring large radial forces and not for transferring large impact forces that travel through the center of the planetary gears.

A disadvantage of the genus-building toothed rotor set is that it does not ensure clean rolling under all operational conditions, without interlocking disturbances. The movement of the planetary gears relative to the bearing ring eventually comes to a standstill.

In this condition, when the planetary gear is almost stationary and simultaneously, a large force is transferred, there is the real danger that the lubrication film between the tooth crest of the planetary gear and the bearing ring may burst, leading to stoppage of the oil flow. The result is fixed body contact through the loss of lubrication oil in the crevices. Favorable hydrodynamic lubrication conditions are no longer there, and these have been replaced by conditions of hybrid friction, which, in the worst scenario case can end in jamming. In case of mixed friction or jamming, erosion takes place, thus reducing the life of the toothed rotor set.

In an advantageous design of the toothed rotor set conforming to the invention therefore, at least one section of the inner and/or outer fine teeth has an arched component. The advantage of a toothed rotor set designed in this manner is that due to the arched component, rolling friction takes place, but no sliding friction is possible, so that erosion of the teeth is minimized.

The convex shaped tooth crest of the fine-toothed planetary gear and the concave shaped tips of the fine-toothed outer rotor ensure that there is surface contact but no linear contact. The Hertz pressing is reduced considerably through this roller pair.

By incorporating a flank clearance between the teeth of the planetary gear and the gaps in the teeth of the outer rotor, it is ensured that transmission of the larger impact forces takes place only over the tooth crest and the tooth tips. This way it is ensured that no large wedging forces impact on the flanks of the tooth system. Such impacts can destroy the flank surfaces. Additionally, the lubrication oil from the gaps between the teeth can flow out through the flank clearance, as otherwise, it might lead to squeezed oil, which can lead to the formation of high pressure.

In an advantageous design of the toothed rotor set conforming to the invention, the crest and/or the tip areas of the teeth are designed in the form of an arc. This kind of shaping of the teeth in the region of the crest and/or tip enables very large impacts (radial forces) to be transmitted. In this process, the part of the radial force to be transferred can be small. In this case, the tooth crest and tip is included in the rolling process, i.e., rolling of the toothed planetary gears on the toothed outer rotor curve, unlike in the case of toothed rotors of known involute teeth systems.

The convex curved tooth flank of the planetary gear and the concave curved tooth flank of the outer rotor create a relatively large contact area during interlocking, which seals the compression chamber during the movement of the compression chamber from the suction area to the compression area. Even deviations in the rectangular alignment of the rotor do not lead to leakage losses in the compression chamber.

In an advantageous design of the invention, there is the provision that particularly the region of the tooth crest and/or tip of the fine tooth system has a flattening. In the main region of force transmission, in which the torque of the inner rotor operates on the toothed outer rotor through the toothed planetary gears, the planetary gears almost come to a standstill. Under conditions of the described relative stationary status, and the simultaneous transmission of a large force, there is the danger that the lubrication film between the planetary gear tooth crest and the oil pockets of the inner rotor may burst.

The tooth crests of the planetary gears were flattened to prevent this. The size of the flattening depends on the use area of the toothed rotor. At low speeds and high pressures, a strong flattening is necessary to ensure the formation of a lubrication film even at low sliding speeds. At high speeds and low pressures, a small flattening is required. A special curve—the cycloid curve—is used for the transfer from the tooth crests of the planetary gear to the flattened surface, which supports the formation of a lubrication film better than a simple transfer radius.

In a further advantageous design of the invention, especially the region of the tooth crest and/or tip has a large curvature radius. Instead of a flattening, it is meaningful to provide a surface with a large curvature radius in the region of the tooth crest and/or tip.

The flattening of the tooth crests of the planetary gear leads to an improvement in force transmission (Hertz pressing) from the planetary gear to the inner rotor.

In a particularly advantageous design of the invention, the arc shaped component is at least partially designed as a cycloid. The cycloid has proved to be especially advantageous in relation to the rolling process and the transmission of impact forces. This cycloid teeth system ensures that even for wide curvature changes and small curvature radiuses, the rolling is smooth and almost slide-proof, leading once again to reduced wear and tear.

In a purposeful design of the invention, the teeth are shaped as involute teeth, at least in the region of the tooth flanks. In this kind of teeth system, the tooth flanks of the toothed outer rotor and the toothed planetary gears are formed through an evolutionary process, so that in this execution model, the interlocking disturbances can be less than in the case of the execution model in which the tooth flanks are designed as cycloids.

In an advantageous design of the invention, the fine teeth system is provided with a near erosion-proof surface. The erosion-proof surface can be achieved easily through a chemical, especially thermo chemical or physical treatment. In addition, the surface can be galvanized. Further advantageous surface treatment processes include carborizing, nitriding and/or nitro carborizing, coating with boron and/or chromium.

In an advantageous design of the invention, at least one fluid duct is provided in the oil pocket region. The fluid duct can be connected to the pressure side of the pump so that there is a constant flow of lubrication oil between the planetary gear and the oil pockets. This ensures an improved formation of lubrication film.

All moveable components of the toothed rotor set, especially the outer rotor and/or the planetary gears and/or the inner rotor have the front side of at least one rotating crosspiece. This rotating crosspiece serves as sealing for the casing in which the toothed rotor set is located. Usually, such moveable parts have a sealing surface on the front side, which stretches over its entire surface. The sealing (conforming to the invention) with the help of the rotating crosspiece offers the advantage that the very high frictional forces that arise in the case of the known sealing is reduced considerably, and the toothed rotor sets work more smoothly and thus more efficiently. The rotating crosspiece has a width that represents the optimum condition between the sealing and the friction.

And finally, the invention relates to a process for the manufacture of a toothed rotor set, according to which, the set is manufactured through a shaping procedure, preferably with the help of a powder metallurgy process, plastic die casting process, flow pressing process, pressure casting process, particularly aluminum pressure casting and punching process.

An expensive teeth system of this kind required by the toothed rotor set conforming to the invention can be produced simply and cost effectively with the help of this process. Manufacturing through machining, grinding, shaping, knocking and sawing, all of which are generally known to be used for creating teeth systems, cannot be used in the case of the invention, because the teeth system here is very complicated.

In an advantageous design of the invention, the toothed rotor set is used in a pump, particularly a lubrication oil pump for internal combustion engines, gears, hydraulic aggregates and high pressure cleaning systems.

In another advantageous design of the invention, provision has been made for the use of the toothed rotor set as an engine.

BRIEF DESCRIPTION OF THE DRAWINGS

The invention is explained in greater detail with the help of schematic diagrams as described below.

DETAILED DESCRIPTION OF THE INVENTION

Figure 1:
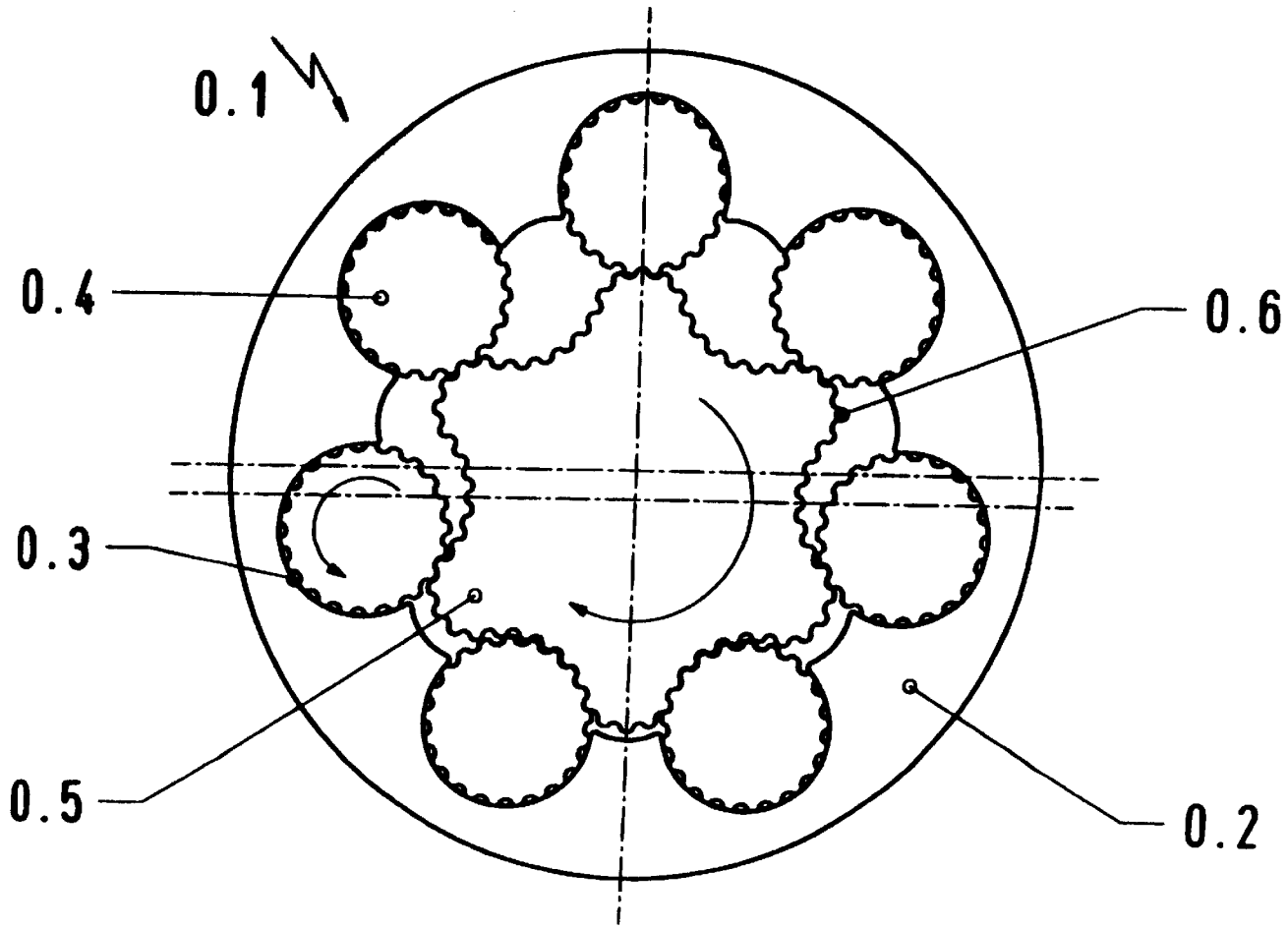
Fig. 1 Prior Art
FIG. 1 A toothed rotor set conforming to the latest technology status.

FIG. 1 shows a toothed rotor set 0.1 conforming to the latest technology status. It consists of a rotating outer rotor 0.2 with oil pockets 0.3, in which rotating planetary gears 0.4 are arranged, having an inner teeth system with an inner rotor 0.5 aligned eccentrically to the outer rotor 0.2. The inner rotor 0.5 has an approximately star shaped outer contour equipped with an outer fine teeth system 0.6. The star-shaped outer teeth system has one tooth less than the inner teeth system. The toothed rotor set 0.1 has seven planetary gears 0.4. A disadvantage of this system is that when the inner rotor 0.5 rotates in the clockwise direction, lubrication oil that flows from the gaps in the teeth of the planetary gear rotating in the same direction and the wall of the oil pockets 0.3 is pumped from the pressure side to the suction side, which ultimately reduces the efficiency of the pump.

Figure 2:
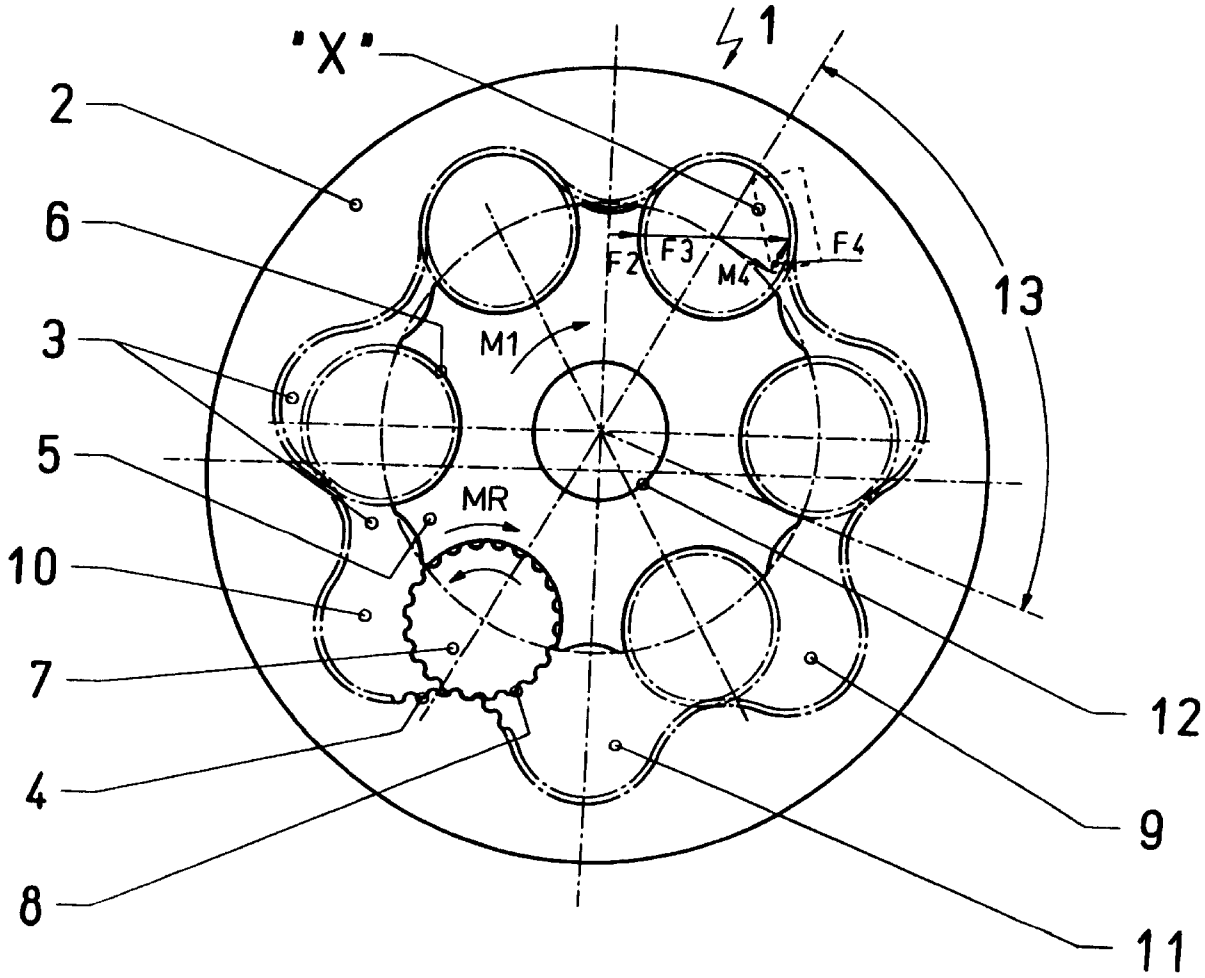
FIG. 2 toothed rotor set conforming to the invention.

FIG. 2 shows a toothed rotor set 1 conforming to the invention, for a pump or an engine. It consists of a rotating outer rotor 2 with an approximately star-shaped bore 3 having an inner fine teeth system 4 and an inner rotor 5 aligned eccentrically in the bore 3 having oil pockets 6 for planetary gears 7. The planetary gears 7 have a fine teeth system 8 with which they roll in the fine teeth system of the outer rotor 2. The outer fine teeth system has one tooth less than the inner teeth system 4 of the outer rotor 2. The toothed rotor set 1 has a suction area 9, a pressure area 10 and compression chambers 11.

In comparison to the toothed rotor set 0.1 illustrated in FIG. 1 and based on the latest technology status, the toothed rotor set 1 conforming to the invention needs only six planetary gears, so that there is less friction.

A drive momentum M1 is applied on the inner rotor 5 through the drive shaft 12. The result is that a force F2 is applied on the planetary gears 7 through the oil pockets 6 of the inner rotor 5. The force F3 in the planetary gear 7 divides itself into two components, the radial force F4 and the torque M4. The force F3 impacts on the toothed outer rotor 2 through the center of the planetary gear 7 and rotates the outer rotor 2. The torque M4 rotates the planetary gear 7. The planetary gear transfers, most of all, the force F3, and in the process, experiences less friction MR attributable to sliding in the oil pockets.

On one hand, the toothed rotor set 1 conforming to the invention can be used as a pump for building pressure. Here, the inner rotor 5 is driven by a drive shaft 12. On the other hand, the toothed rotor set 1 conforming to the invention can be used as an engine in which the pressure area 10 is impacted with pressure, which sets the inner rotor in rotation and drives the drive shaft 12.

In the main area of force transmission 13, in which the torque is applied to the outer rotor 2 through the inner rotor 5 equipped with oil pockets 6 over the toothed planetary gear 7, the planetary gear 7 comes to a standstill. When the planetary gear comes to the described, geometrically conditioned relative standstill, and simultaneously, a large force is transmitted, there is the danger that the lubrication oil film between the planetary gear tooth crest and the inner rotor 5 might burst.

Figure 2A:
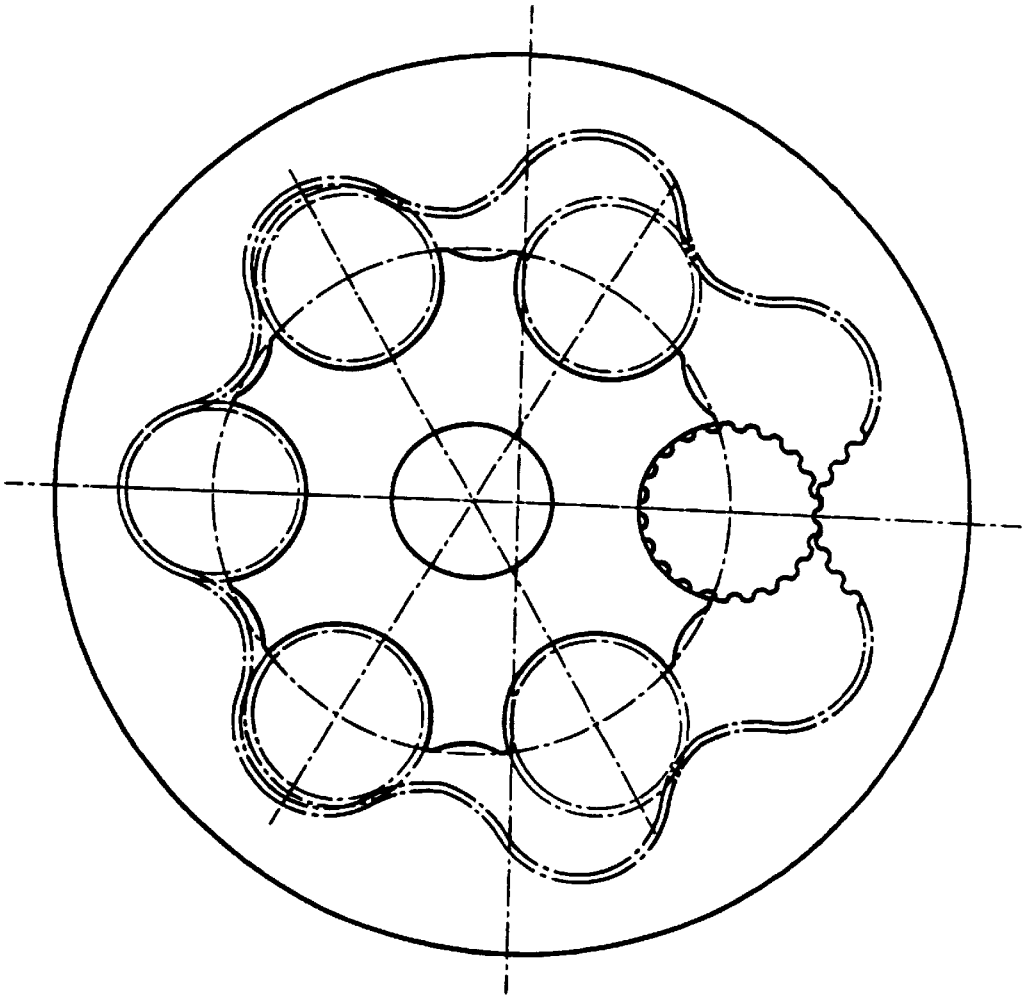
FIG. 2*a* A toothed rotor set conforming to the invention in a second working position.

FIG. 2*a* shows the toothed rotor set 1 in a second working position. The tight interlocking of the fine teeth systems can be seen viewed here rather well.

Figure 2B:
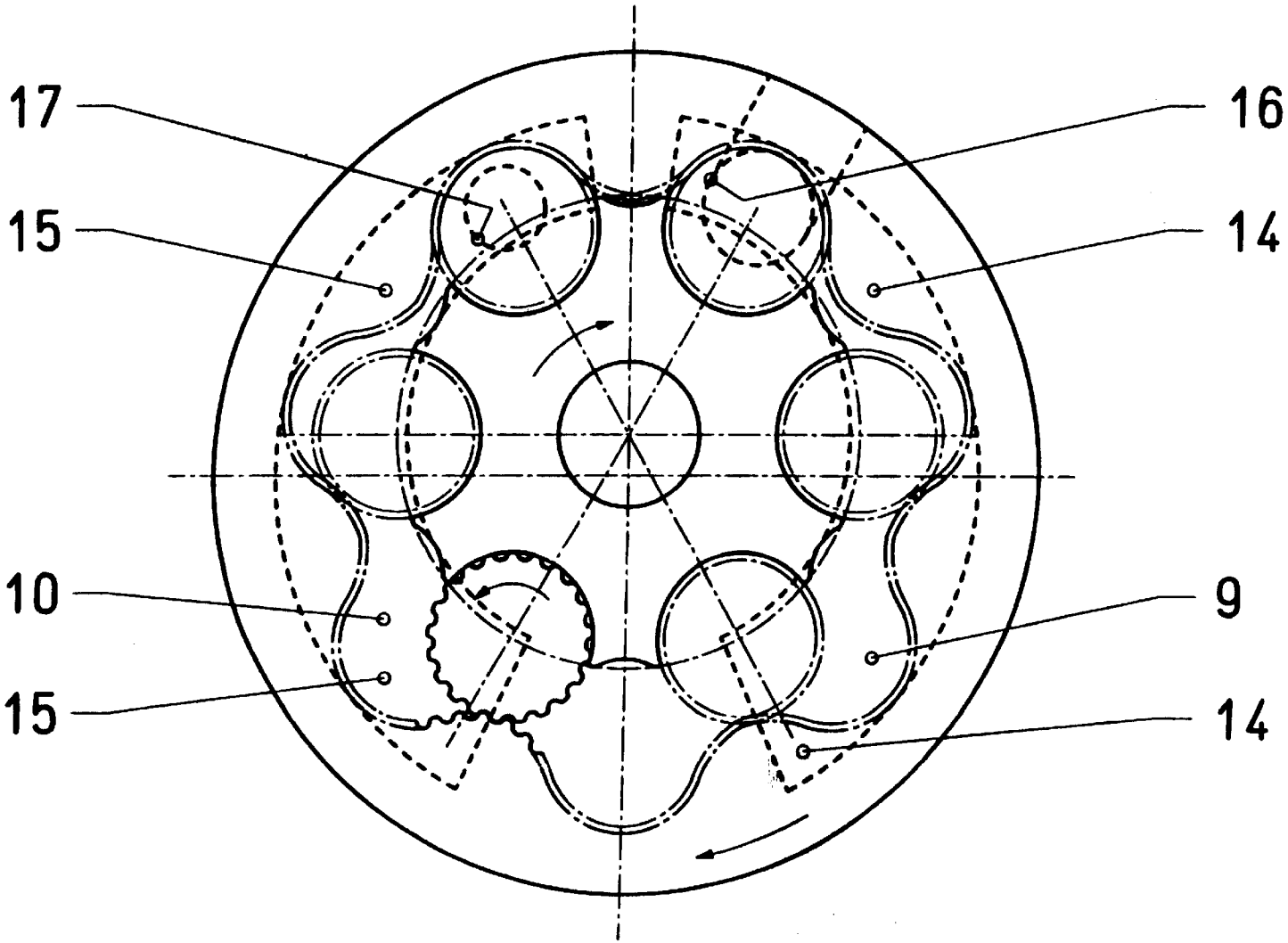
FIG. 2*b* An overview of a toothed rotor set conforming to the invention with suction side and pressure side.

FIG. 2*b* shows an overview of the toothed rotor set 1 in which both, a suction side 14 and a pressure side 15 are illustrated. An inlet hole 16 ends in the suction side 14, which for example, can be designed laterally as a bore in the casing containing the toothed rotor set 1. Similarly, an outlet hole 17 ends in the pressure side 15. The diameter of the outlet hole 17 is smaller than the diameter of the inlet hole 16, because the latter has a higher flow speed. It can also be seen here that when the inner rotor 5 rotates in the clockwise direction, the planetary gears rotate in the anti-clockwise direction, so that additional lubrication oil in the gaps between the teeth of the planetary gears flows from the suction side to the pressure side.

Figure 3:
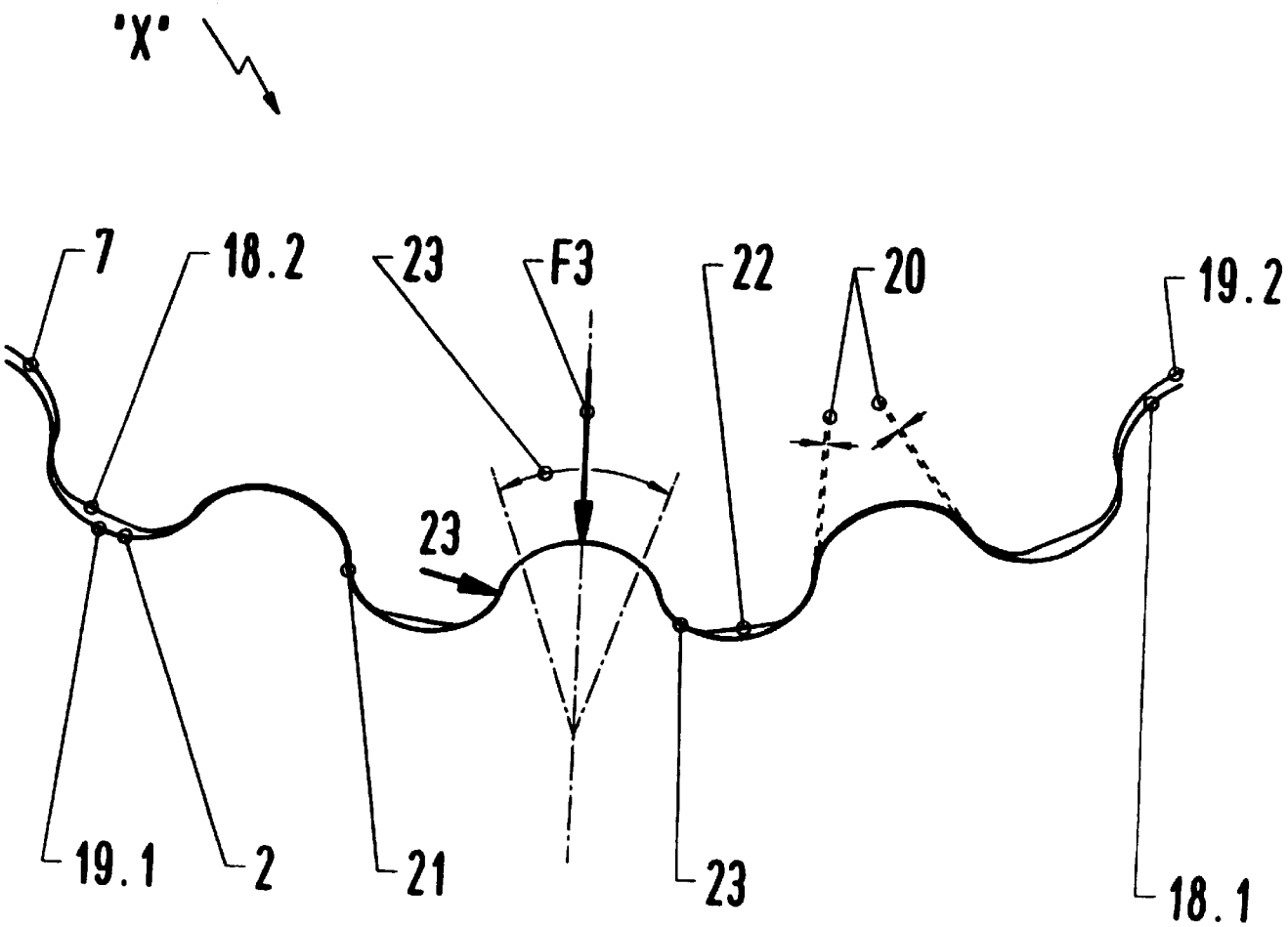
FIG. 3 A variant of a toothed rotor set conforming to the invention corresponding to the detail X in FIG. 2.

FIG. 3 show a variant 1 of the teeth system conforming to the invention, according to the detail X in FIG. 2. The large force represented in FIG. 2 and the small friction MR must be transferred. In this teeth system, the tooth crest 18 and the tooth tip 19 are included in the rolling process. In other words they are included in the rolling of the toothed planetary gear 7 on the toothed outer rotor curve 2. In the teeth system represented in FIG. 3, the surface components of the teeth system are selected in such a way that they correspond to the force distribution.

The largest component, the arc-shaped component 23 of the teeth system thus exists at the tooth crest 18 and the tooth tip 19, which transfer the force F3 between the toothed planetary gear 7 and the toothed outer rotor 2. Only a small portion of the teeth system surface consists of sliding surfaces in the region of the teeth flanks, which converts the friction momentum MR into rotation of the toothed planetary gear 7.

The tooth crest 18.1 of the toothed outer rotor 2 is so designed that it fits exactly into the tooth tip 19.2 of the toothed planetary gear 7, ensuring a smooth and problem-free rolling. Inversely, the tooth crest 18.2 of the planetary gear 7 interlocks with the tooth tip of the toothed outer rotor 2.

The convex shaped tooth crest 18.1 of the toothed outer rotor 2, and the concave shaped tooth tip 19.2 of the toothed planetary gear 7, meet in a contact area and not a contact line. The Hertz pressure is reduced considerably through this roller pairing.

This is also true of the teeth flanks of the toothed outer rotor 2 and the toothed planetary gear 7. The incorporation of a flank clearance 20 between the teeth of the planetary gear 7 and the teeth gaps in the outer rotor 2 ensures that the large impact force F3 is transmitted only through tooth crest 18 and tooth tip 19. This prevents large wedge forces, which can destroy the flank surfaces, from impacting on the teeth flank 21. In addition, the lubrication oil from the teeth gaps 20 can flow out of the flank clearance. Otherwise, it might lead to squeezed oil, which can generate high pressure.

Figure 4:
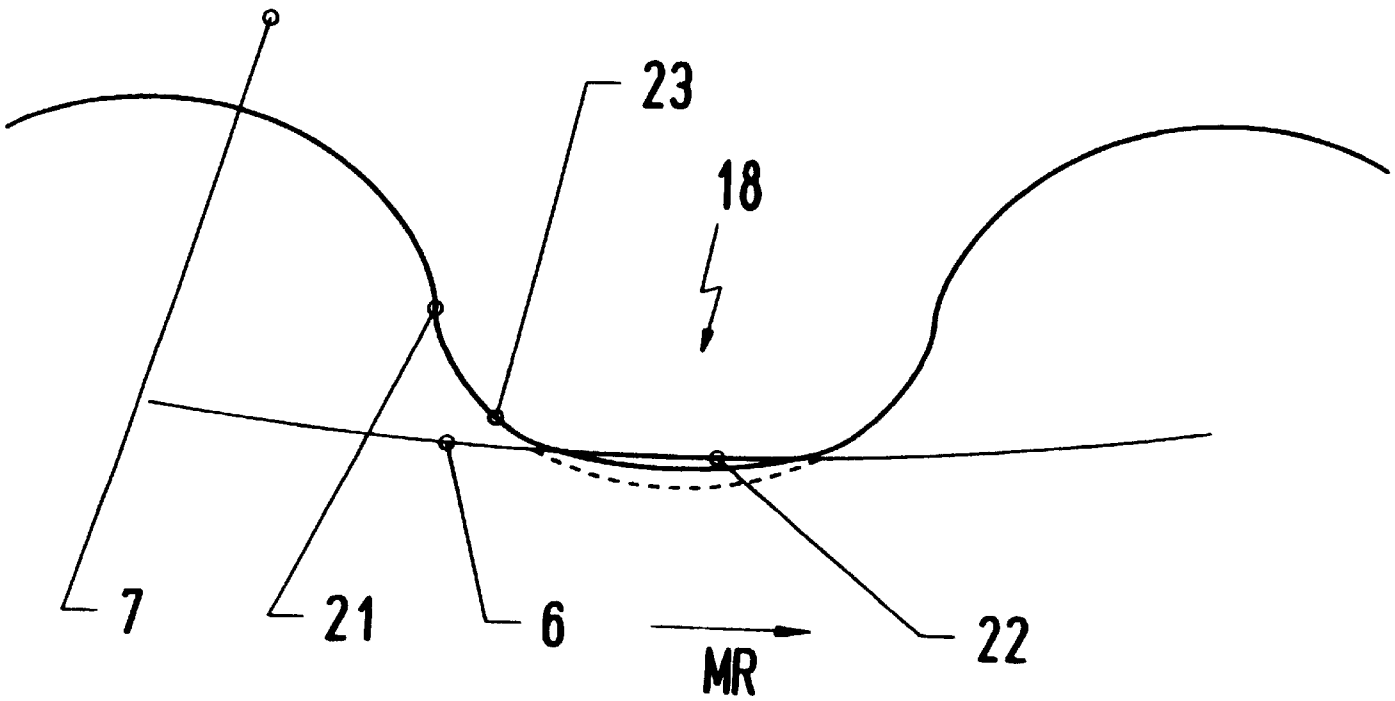
FIG. 4 A position II of the toothed rotor set conforming to the invention.

FIG. 4 shows a second position of the teeth system conforming to the invention. When the planetary gear 7 comes to the described relative standstill, and a large force is transferred simultaneously, there is the danger that the lubrication oil film between the planetary gear tooth crest 18 and the oil pocket 6 of the inner rotor 5 can burst. To prevent this from happening, the planetary gear tooth crests 18 are flattened. The size of the flattening 22 depends on the use area of the toothed rotor 1. At low speeds and high pressures, a large flattening 22 is necessary. At high speeds and low pressures, a medium flattening is sufficient to build a continuous lubrication oil film. A cycloid 23 was used for the transfer from the tooth flank 21 of the planetary gear 7 to the flattened surface 22. The cycloid 23 supports the formation of lubrication film better than a simple transfer radius.

The flattening 22 of the planetary gear tooth crests 18 also leads to an improved transmission of forces (Hertz pressing) from planetary gear 7 to the oil pockets 6 of the inner rotor 5.

Figure 5:
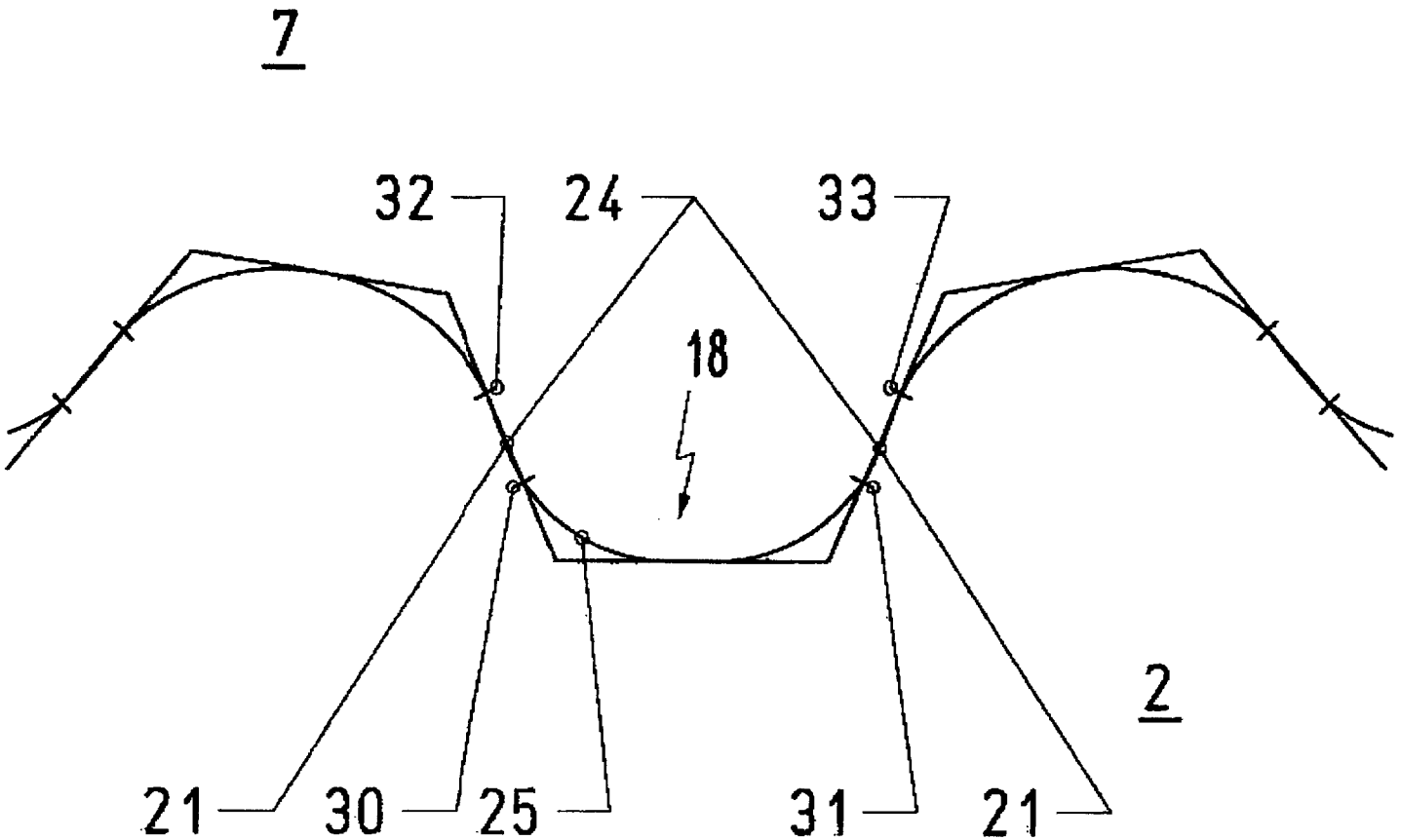
FIG. 5 A variant III of the toothed rotor set conforming to the invention.

FIG. 5 shows a third variant of the teeth system conforming to the invention in which teeth flanks 21 of both the toothed outer rotor 2 and the toothed planetary gears 7 are shaped by an involute 24, as indicated between points 30 and 32 and between points 31 and 33. In contrast, the tooth crest 18 of the planetary gear 7 is shaped as a cycloid 25, as indicated between points 30 and 31. In this execution model however, the probability factor for the appearance of interlocking disturbances is very high.

What is claimed is:

1. A toothed rotor set comprising:

a rotating outer rotor including an approximately star shaped bore and an inner fine teeth system;

planetary gears including an outer fine teeth system for engaging the inner fine teeth system of the outer rotor, outer teeth of the planetary gears numbering one less than the inner teeth of the outer rotor; and an inner rotor, aligned eccentrically with the outer rotor, including pockets formed therein for receiving the planetary gears.

2. The toothed rotor set according to claim 1, wherein the teeth have a near-erosion-proof surface.

3. The toothed rotor set according to claim 1, wherein sliding friction between the teeth is substantially zero such that wear of the teeth is minimized.

4. The toothed rotor set according to claim 1, further comprising at least one fluid duct proximate the pockets.

5. The toothed rotor set according to claim 1, further comprising a rotating crosspiece coupled to at least one of the outer rotor, planetary gears, and the inner rotor.

6. The toothed rotor set according to claim 1, wherein the pockets are oil pockets.

7. The toothed rotor set according to claim 1, wherein said toothed rotor set forms a pump.

8. The toothed rotor set according to claim 1, wherein said toothed rotor set forms a engine.

9. The toothed rotor set according to claim 1, wherein at least a portion of at least one of the inner fine teeth system and the outer fine teeth system comprises a curved shape.

10. The toothed rotor set according to claim 9, wherein at least a portion of at least one of the inner teeth and the outer teeth form an arc-like shape in at least one of a crest and a tip thereof.

11. The toothed rotor set according to claim 9, wherein the curved shape is defined by a large curvature radius.

12. The toothed rotor set according to claim 9, wherein at least some of the inner teeth and the outer teeth include a relatively flat portion proximate at least one of a crest and a tip thereof.

13. The toothed rotor set according to claim 9, wherein the curved shape is at least partially formed by a cycloid.

14. The toothed rotor set according to claim 9, wherein flanks of the inner teeth and the outer teeth include an involute shape.

* * * * *